US009074390B2

(12) United States Patent
Butt et al.

(10) Patent No.: US 9,074,390 B2
(45) Date of Patent: Jul. 7, 2015

(54) LOCK ASSEMBLY

(75) Inventors: Simon James Butt, Sydney (AU); Marc Cohen, Sydney (AU)

(73) Assignee: TNBT Holdings Pty Limited, Moorebank (AU)

( * ) Notice: Subject to any disclaimer, the term of this patent is extended or adjusted under 35 U.S.C. 154(b) by 0 days.

(21) Appl. No.: 13/266,113

(22) PCT Filed: Apr. 27, 2010

(86) PCT No.: PCT/AU2010/000482
§ 371 (c)(1),
(2), (4) Date: Nov. 21, 2011

(87) PCT Pub. No.: WO2010/121332
PCT Pub. Date: Oct. 28, 2010

(65) Prior Publication Data

US 2012/0079861 A1 Apr. 5, 2012

(30) Foreign Application Priority Data

Apr. 24, 2009 (AU) ..... 2009901796

(51) Int. Cl.
*E05B 27/00* (2006.01)

(52) U.S. Cl.
CPC ..... *E05B 27/0017* (2013.01); *E05B 27/0057* (2013.01)

(58) Field of Classification Search
USPC ..... 70/356, 492, 493, 372, 376–378, 419, 70/495, 496, 409
See application file for complete search history.

(56) References Cited

U.S. PATENT DOCUMENTS

| | | | | |
|---|---|---|---|---|
| 4,638,651 | A * | 1/1987 | Surko, Jr. | 70/495 |
| 5,964,112 | A | 10/1999 | Stefanescu | |
| 7,707,864 | B1 | 5/2010 | Melendez et al. | |

(Continued)

FOREIGN PATENT DOCUMENTS

| | | |
|---|---|---|
| EP | 0 237 172 | 9/1987 |
| EP | 2 031 161 | 3/2009 |
| FR | 2 758 847 | 7/1998 |
| GB | 1904 21839 | 11/1904 |
| GB | 112761 | 1/1918 |
| NL | 7 803 341 | 10/1979 |

OTHER PUBLICATIONS

International Searching Authority, International Search Report for International Application No. PCT/AU2010/000482, Jul. 30, 2010, 5 pages, Australian Patent Office, Australia.

(Continued)

*Primary Examiner* — Suzanne Barrett
(74) *Attorney, Agent, or Firm* — Alston & Bird LLP

(57) ABSTRACT

The present invention relates to a lock assembly which includes a lock body. The lock body is adapted to receive a lock barrel. The lock barrel has a plurality of passages. Each of the passages is in communication at one end with the lock body and open at the other end. The lock assembly also includes at least one wafer and a lower pin part. The wafer is received in one of the passages. The lower pin part is received in at least one of the remainder of the passages. The wafer has a column. One end of the column is adapted to include a key engaging surface while the other end is adapted to rest on a wall of the lock body. The lock barrel has a key slot which is in communication with the passages. The key slot is adapted to receive a key with a low cut adapted to correspond to the key engaging surface. The column is so configured as to provide a gap between the key engaging surface and the low cut when the key is a bump key.

10 Claims, 15 Drawing Sheets

(56) References Cited

U.S. PATENT DOCUMENTS

| | | | | |
|---|---|---|---|---|
| 7,775,074 | B1 * | 8/2010 | Tobias et al. | 70/493 |
| 7,963,135 | B1 * | 6/2011 | Tobias et al. | 70/493 |
| 8,336,346 | B2 | 12/2012 | Mah | |
| 2008/0271507 | A1 | 11/2008 | Hocut | |
| 2009/0107195 | A1 | 4/2009 | Gallian | |
| 2010/0050717 | A1 * | 3/2010 | Chiang et al. | 70/377 |
| 2010/0319420 | A1 * | 12/2010 | Ng et al. | 70/367 |
| 2011/0271724 | A1 * | 11/2011 | Huang et al. | 70/493 |

OTHER PUBLICATIONS

International Searching Authority, Written Opinion for International Application No. PCT/AU2010/000482, Jul. 30, 2010, 8 pages, Australian Patent Office, Australia.

International Preliminary Examining Authority, International Preliminary Report on Patentability, including Applicant's Demand of Feb. 24, 2011, for International Application No. PCT/AU2010/000482, Aug. 15, 2011, 19 pages, Australian Patent Office, Australia.

* cited by examiner

LOCK ASSEMBLY

TECHNICAL FIELD

This invention relates to a lock assembly. More particularly, this invention is concerned with a pin tumbler lock assembly, although the scope of the invention is not limited thereto.

BACKGROUND OF THE INVENTION

Lock bumping in recent years has become a serious problem in the lock industry, impacting on the reliability and security of pin tumbler locks in particular.

Lock bumping generally involves using a key with a reduced stopper/shoulder and a series of low key cuts. Once such a key is inserted into the key slot, the engaging surface of each pin can be located right up against the side of each cut (as opposed to the middle of each cut). A pre-rotational tension is then applied to the key followed by continuous tapping on the head of the key. These actions cause the upper level pins to jump upwards inside the apertures containing the pins within the lock cylinder. With a certain degree of dexterity, synchronised jumping of the upper level pins can result in all the upper level pins clearing the shear line at the same time, thereby permitting turning of the lock cylinder with respect to the lock body and hence opening of the lock.

It is therefore desirable to provide a lock assembly which will at least reduce the likelihood of unauthorised opening of a lock by way of lock bumping.

SUMMARY OF THE INVENTION

According to one aspect of the present invention, there is provided a lock barrel for a lock assembly, the lock barrel including a plurality of passages, each communicating at one end with a lock body and being open at the other end;

wherein at least one of the passages is adapted to receive a wafer while at least one of the remainder of the passages is adapted to receive a lower pin part.

According to another aspect of the present invention, there is provided a lock assembly including:

a lock body adapted to receive a lock barrel, the lock barrel having a plurality of passages, each communicating at one end with the lock body and being open at the other end;

at least one wafer being received in one of the passages; and a lower pin part being received in at least one of the remainder of the passages.

According to a further aspect of the present invention, there is provided a lock assembly including a lock barrel adapted to be received in a lock body, the lock barrel including:

a plurality of passages, at least one of which being adapted to receive a wafer having a column, one end of the column being adapted to include a key engaging surface whilst the other end is adapted to rest on a wall of the lock body; and a key slot being in communication with the passages and adapted to receive a key with a low cut adapted to correspond to the key engaging surface;

wherein the column is configured so as to provide a gap between the key engaging surface and the low cut when the key is a bump key.

According to a yet further aspect of the present invention, there is provided a wafer adapted to be in use received within at least one of a plurality of passages of a lock barrel with a key slot, the at least one passage being in communication with the key slot, the lock barrel being adapted to be received within a lock body, the wafer including:

a key engaging surface; and a column being associated with the key engaging surface and adapted to at one end rest on an interior of the lock body;

wherein the column is configured such that it provides a gap between the key engaging surface and a corresponding low cut of a bump key, if and when inserted into the key slot.

The lock body is preferred to include a portion with a plurality of chambers therein. In a preferred embodiment, the chambers are cylindrical in shape. Each of the chambers is preferred to be adapted to correspond to one of the passages in the lock barrel. Each chamber may be adapted to accommodate a biasing means abutting an upper pin part which in use is adapted to cooperate with a corresponding lower pin part.

In a preferred embodiment, at least one of the passages is capable of receiving a pin or a wafer. The passage includes a pin hole for receipt of the pin and a broach slot for receipt of the wafer, the pin hole preferably being in communication with the broach slot.

It is intended that one or more wafers are used in combination with pins in the lock barrel to reduce the likelihood of unauthorised opening or bumping of the lock assembly of the present invention.

Preferably, the wafer is movable between a projecting position and a retracted position. The wafer may include an element having a column with a key engaging surface extending from the column in a first direction, and a biasing means engaging surface extending in a second direction. The biasing means in this embodiment includes a spring adapted to bias a code-carrying portion extending in a third direction with respect to the column.

The biasing means in a preferred embodiment acts on part of an extension projecting in a fourth direction with respect to the column. The extension is preferred to be configured to enter an aperture provided in the lock body when the wafer is in the projecting position.

When the correct key is inserted, it lifts the wafer against the biasing means sufficiently to retract the extension projecting in the fourth direction from the aperture provided in the lock body, thus clearing the shear line in that region. However, the code-carrying portion of the wafer is not lifted sufficiently to project beyond the shear line. If an incorrect key having a cut which is too high is used, the extension projecting in the fourth direction may be retracted from the aperture, but the code-carrying portion will be lifted too high, so that it projects across the shear line, preventing rotation of the lock barrel. If the incorrect key has a cut which is too low, the extension projecting in the fourth direction will not be lifted sufficiently out of the aperture and the wafer will still cause interference at the shear line.

In the embodiment described above, the extension projecting in the fourth direction with respect to the wafer column prevents rotation of the lock barrel when the wafer is in the projecting position. It is an option to add a further layer of security, to increase shear resistance if an attempt was made to forcefully rotate the lock barrel. This can be achieved by including an upper pin part together with a biasing means in the chamber communicating with the passage in which the wafer is located. In this way, when the lock barrel is locked within the lock body, the extension of the wafer projecting in the fourth direction will extend beyond the shear line and in addition the upper pin part will interfere with the shear line.

It will be appreciated by one skilled in the art that the lock assembly of the invention may have one or several wafers and that, for each wafer, there may be included an upper pin part and biasing means, or an upper pin part and biasing means may be included for some but not all of the wafers. Optionally, the biasing means may be omitted. This illustrates the versatility of the assembly of the invention.

In an alternate embodiment, the extension which projects from the column may take the form of a branch with a flat bottom which is adapted to at least partially rest on a floor of an annular wall of the lock body when the wafer is in the projection position. In this embodiment, the lock body may omit the aperture. This results in a slight reduction in security but offers the benefit of reducing manufacturing costs without compromising the ability of the lock assembly to prevent bumping.

In a further embodiment, the wafer may include a pin-shaped top connected to a bar. The pin-shaped top is adapted to abut the upper pin part whilst a bottom end of the bar is adapted to rest on the floor of the annular wall of the lock body. Preferably, the pin-shaped top include a key engaging surface adapted to in use engage a cut of a key. More preferably, the bar has such a length that a gap is provided between a low cut of a bump key and the key engaging surface when the wafer is in the projecting position, so as to reduce the likelihood of unauthorised bumping of the lock assembly.

BRIEF DESCRIPTION OF THE DRAWINGS

The invention may be better understood from the following non-limiting description of preferred embodiments, in which;

FIG. 1*b* is an exploded perspective view from below of the lock assembly of FIG. 1;

DETAILED DESCRIPTION OF THE DRAWINGS

Figure 1A:
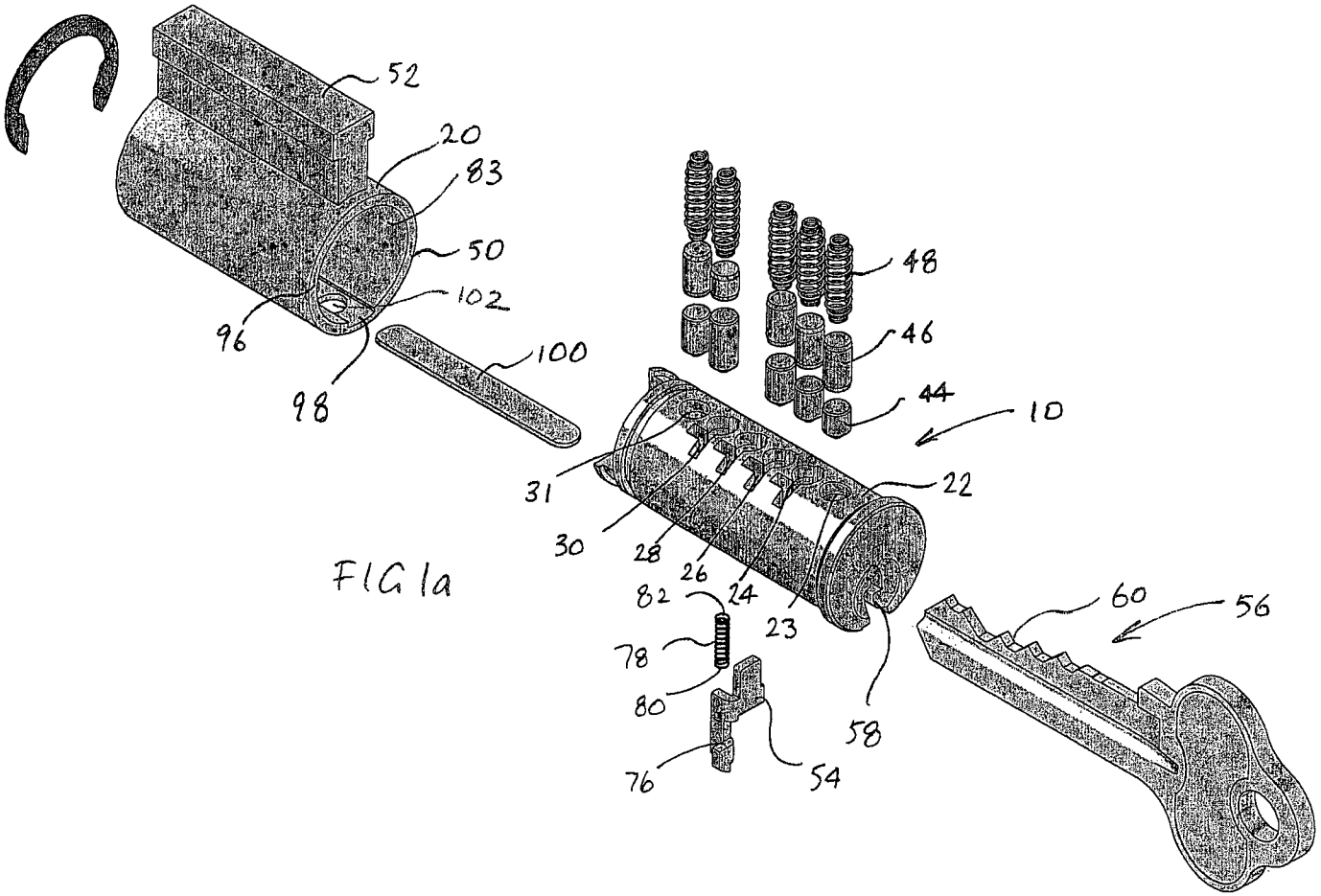
FIG. 1*a* is an exploded perspective view from above of one embodiment of a lock assembly of the present invention.

Referring to FIGS. 1*a*, 1*b*, 2 and 3, a lock assembly 10 includes a lock body 20 which in use receives a lock barrel 22. The lock barrel 22 has a series of passages 23, 24, 26, 28, 30 and 31. Each of the passages 24, 26, 28 and 30 is in communication with the lock body 20 at an upper end 64 and is left open at the lower end 66 (refer FIGS. 5 and 6).

The lock body 20 includes a cylindrical portion 50 and an elevated T-shaped portion 52. The T-shaped portion 52 includes a series of chambers 32, 34, 36, 38, 40 and 42, which are cylindrical in shape (refer FIG. 3). Each of the chambers 32, 34, 36, 38, 40 and 42 corresponds to one of the passages 23, 24, 26, 28, 30 and 31 when the lock barrel 22 is put in place within the lock body 20.

Figure 3:
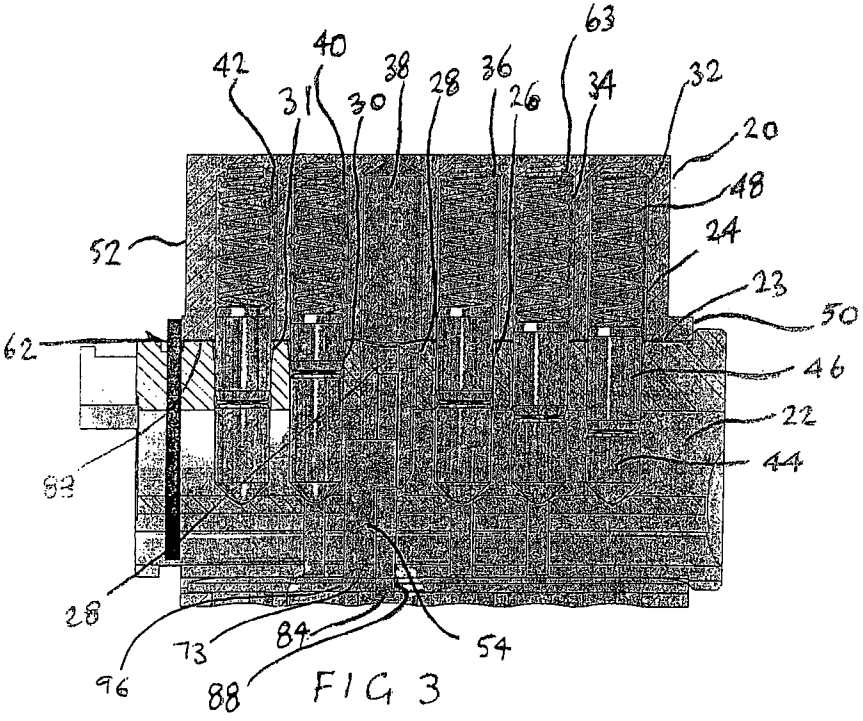
FIG. 3 is a cross sectional view of the assembled lock assembly of FIG. 2 taken along the line indicated by A-A in FIG. 2.

The lock assembly 10 also includes lower and upper pin parts 44 and 46, respectively. The lower pin parts 44 are received in the respective passages 23, 24, 26, 30 and 31. Each of the lower pin parts 44 is in contact with a corresponding upper pin part 46, as best shown in FIG. 3. Each of the chambers 32, 34, 36, 40 and 42 accommodates a biasing means in the form of a spring 48 abutting an upper pin part 46 which cooperates with a corresponding lower pin part 44. For convenience, only one of spring 48, upper pin 46 and lower pin 44 is labeled in FIG. 3. In use, the upper pin parts 46 are biased to engage and abut the respective lower pin parts 44 by the springs 48. Once a correct key 56 is inserted into a slot 58 (refer FIGS. 1*a* and 1*b*) which is in communication with all of the passages 23, 24, 26, 28, 30 and 31, the key cuts (for example, cut 60) will push the code carrying lower pin parts 44 upward, which in turn will drive upper pin parts 46 towards an upper end 63 of the chambers 32, 34, 36, 38, 40 and 42.

Figure 6:
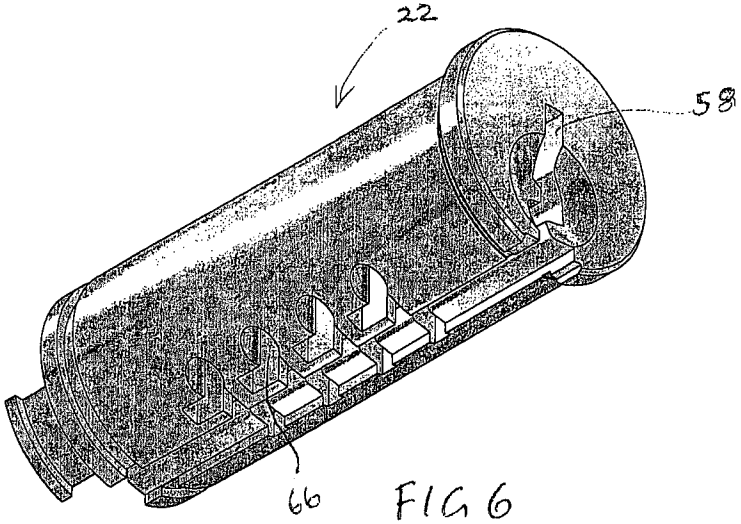
FIG. 6 is a perspective view from below of the lock barrel of FIG. 5.

With reference to FIGS. 1*a*, 1*b*, 3 and 4, the passage 28 of the lock barrel 22 receives a wafer 54. As best shown in FIGS. 1*a*, 1*b* and 6, the wafer 54 enters the passage 28 from the lower open end 66. The wafer 54 when in use is movable between a projecting position and a retracted position.

Figure 8:
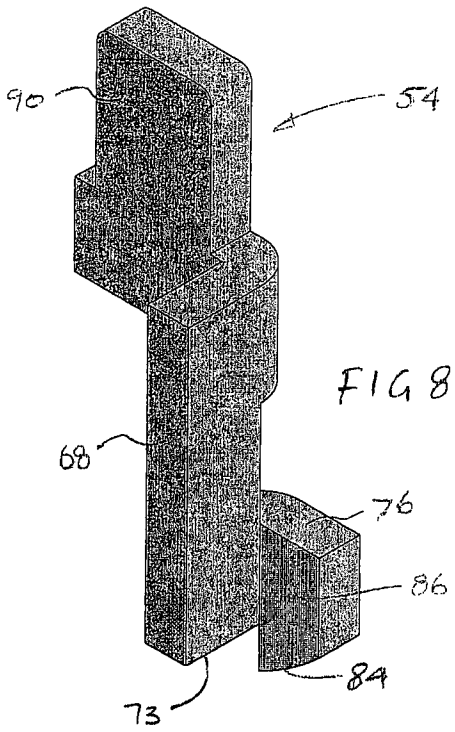
FIG. 8 is a perspective view from the back of the wafer of FIG. 7.
Figure 7:
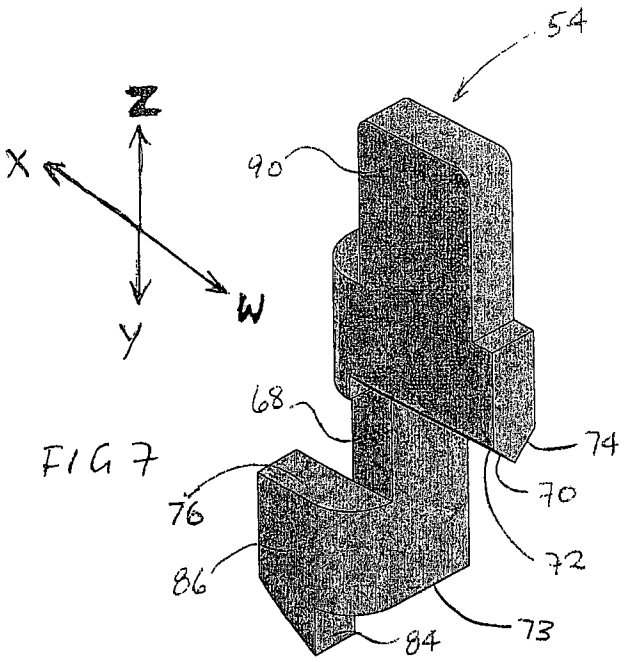
FIG. 7 is a perspective view from the front of a wafer of the lock assembly of FIG. 1.
Figure 10:
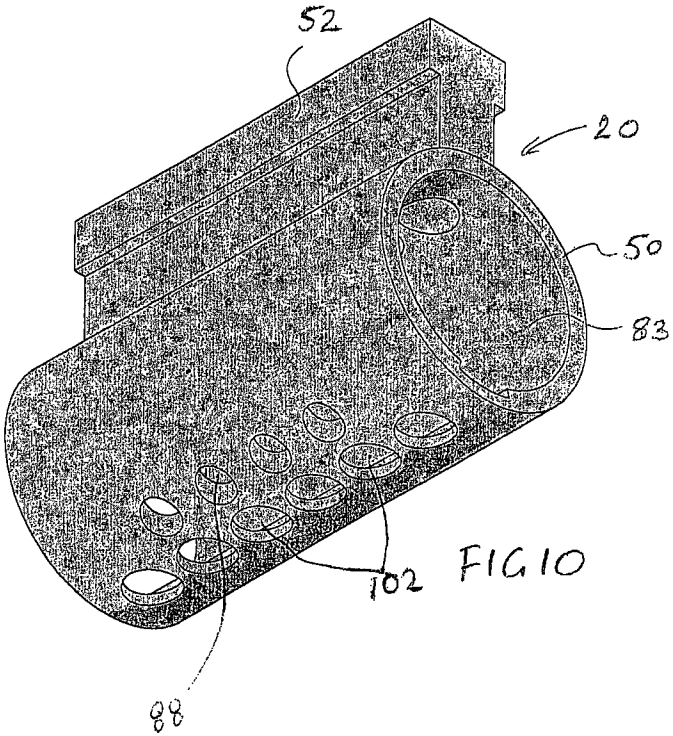
FIG. 10 is a perspective view from below of the lock body of FIG. 9.
Figure 9:
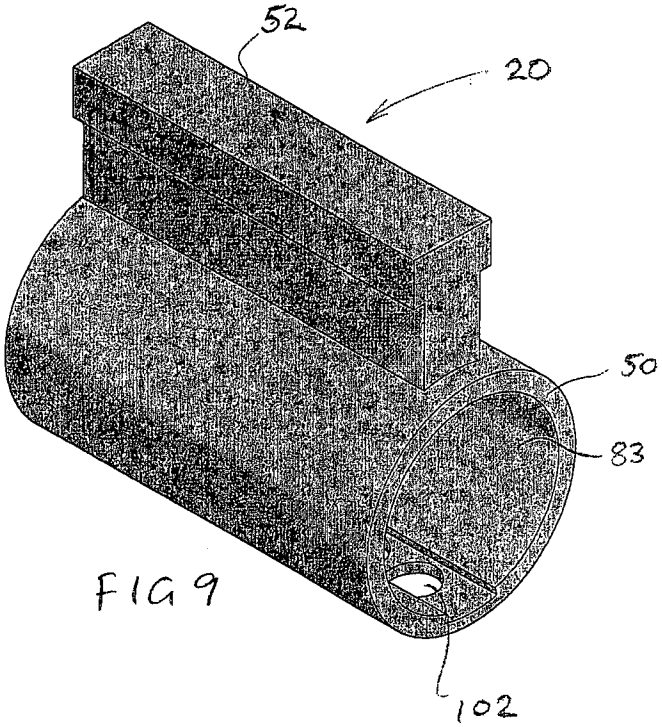
FIG. 9 is a perspective view from above of a lock body of the lock assembly of FIG. 1.

Referring to FIGS. 7 and 8, the wafer 54 takes the form of an irregular three dimensional element having a column 68 with a key engaging surface 70 extending from the column 68 in direction W. The key engaging surface 70 includes a first slanting face 72 which contacts the key cuts 60 as the key 56 moves into the key slot 58, and a second slanting face 74 which contacts the key cuts 60 as the key 56 moves out of the key slot 58. The column 68 ends with a bottom 73 which is designed to rest on the floor of the annular wall 96 of the lock body 20. As such, it will be appreciated that the location of the key engaging surface 70 is dictated by the height of the column 68. It is intended that the column has a certain set height such that if and when a bump key is inserted into the key slot 58, there will be a clearance or gap between a corresponding low cut of the bump key and the key engaging surface 70. This is to prevent unauthorised opening of the lock assembly 10 by bumping the lock barrel with the bump key.

The wafer 54 also includes a portion 86 extending from the column 68. The portion 86 includes a biasing means engaging surface 76 extending in direction X. The bottom end of the portion 86 includes an extension in the form of a wedge 84 which extends in direction Y. The biasing means is a spring 78 (refer FIGS. 1*a* and 1*b*) which is inserted into the passage 28 prior to insertion of the wafer 54 from the lower open end 66 during installation. The spring 78 has a lower end 80 abutting the biasing means engaging surface 76 and an upper end 82 abutting a shoulder 81 (refer FIG. 4) provided inside the lock barrel 22. The spring 78 is held in position once the wafer 54 is inserted into the passage 28.

Figure 11:
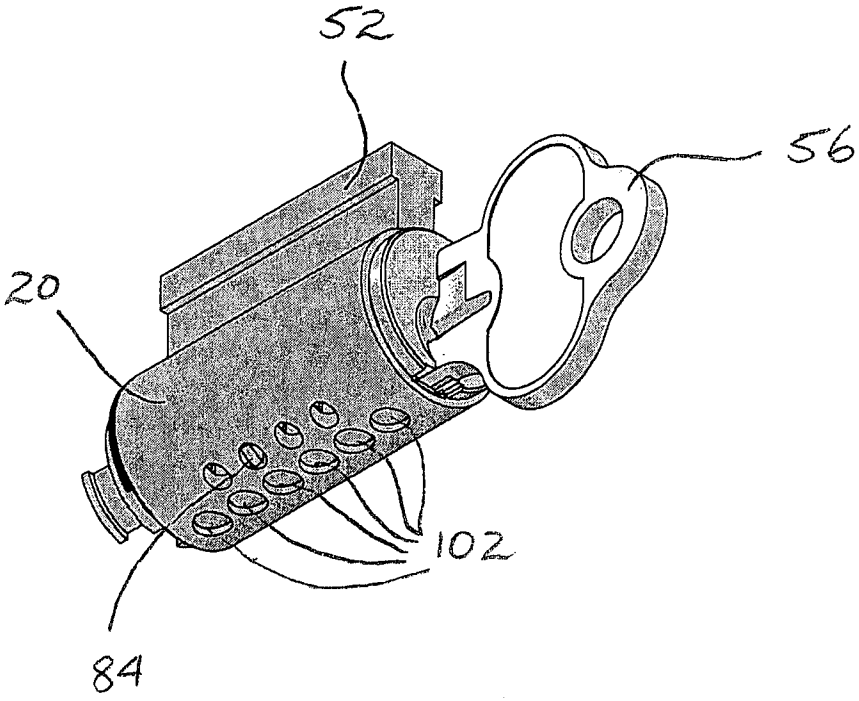
FIG. 11 is a perspective view from below of an assembled lock assembly of FIG. 1 with a key inserted therein.

When the key 56 is not inserted into the key slot 58, the wedge 84 of the wafer 54, being in a projecting position, sits inside the aperture 88 (FIG. 3), prevents the barrel 22 from rotating relative to the lock body 20. As shown in FIG. 11, when the correct key 56 is fully inserted, the cut 60 which corresponds to and lines up with the wafer 54 will move the wafer 54 out of the aperture 88 to a retracted position, thereby allowing the barrel 22 to rotate within the lock body 20.

In contrast, if an incorrect key is inserted into the key slot 58, the cut 60, if too high, would not correspond with the code (which in the present embodiment is 90) of the wafer 54. As a consequence, the wafer 54, which includes a code carrying portion 90 (refer to FIGS. 7 and 8) extending in direction Z, will rise in direction Z causing the code carrying portion 90 to project up into the chamber 38. This results in the portion 90 extending beyond shear line 62, thereby stopping the barrel 22 from rotating within lock body 20. Furthermore, if an incorrect key having a cut which is too low is inserted, the wafer 54 will not lift sufficiently and therefore the wedge 84 (being part of the wafer 54 which is constantly biased by the spring 78) will remain in the aperture 88. This prevents the barrel 22 from rotating relative to the lock body 20.

When the key 56 is an appropriate or customised key, the upper pin parts 46 are driven upward and out of the respective passages 23, 24, 26, 30 and 31 into the chambers 32, 34, 36, 40 and 42 by the corresponding parts of the key cuts 60.

It can be appreciated that the correct key 56 functions to keep both the upper pin parts 46, and the wedge 84 and portion 90 of the wafer 54 clear of the shear line 62 thereby permitting rotational movement of the lock barrel 22 relative to the lock body 20.

Referring to FIGS. 1*a*, 1*b* and 3, the passages 24, 26, 28 and 30 are all configured such that they are capable of receiving upper and lower part pins or a wafer. Each of the passages 24, 26, 28 and 30 includes a pin hole 92 (best shown in FIG. 5) for receipt of the upper and lower pins. Each pin hole 92 is in communication with a broach slot 94 for receipt of a wafer. For convenience, only two pin holes 92 and broach slots 94 are labeled in FIG. 5.

It should be appreciated that the lock assembly 10 of the present invention may be used with one or more wafers, as desired. Also, the one or more wafers may be inserted into specifically chosen passages while the remainder of the passages carry pin parts. This combination of pins and wafer arrangement is intended to significantly reduce the likelihood of unauthorised opening or bumping of the lock assembly 10.

Referring now to a second embodiment of the lock assembly 110 of the invention which is shown in FIGS. 12 to 15, many parts are the same as in FIGS. 1 to 11 and the same labels are used for those parts.

Figure 12:
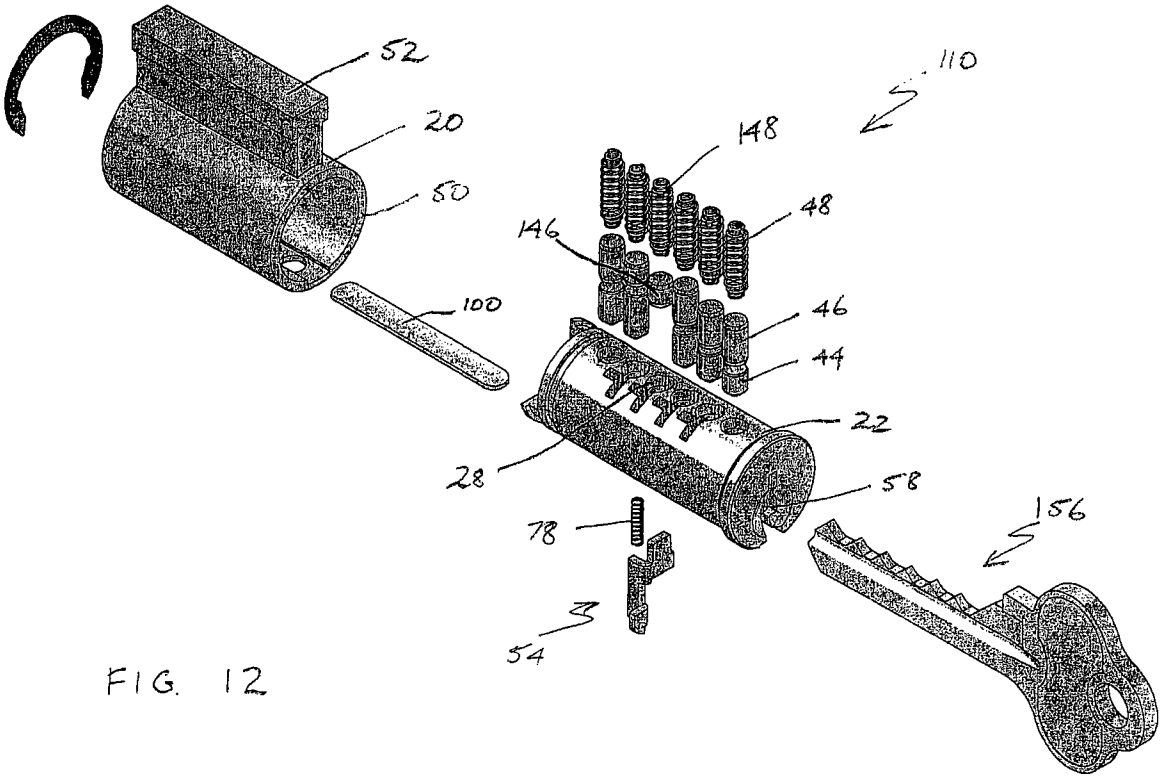
FIG. 12 is an exploded perspective view from above of a second embodiment of lock assembly of the present invention.
Figure 13:
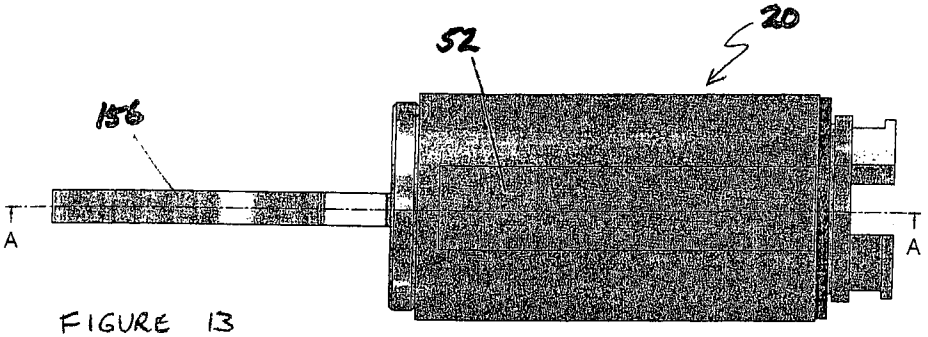
FIG. 13 is a plan view of the lock assembly of FIG. 12.

As can be seen from FIG. 12, the second embodiment varies from the first in that, included in chamber 38 above passageway 28 for wafer 54 is upper pin 146 and spring 148. In this embodiment, key 156 is a "bump" key.

Figure 14:
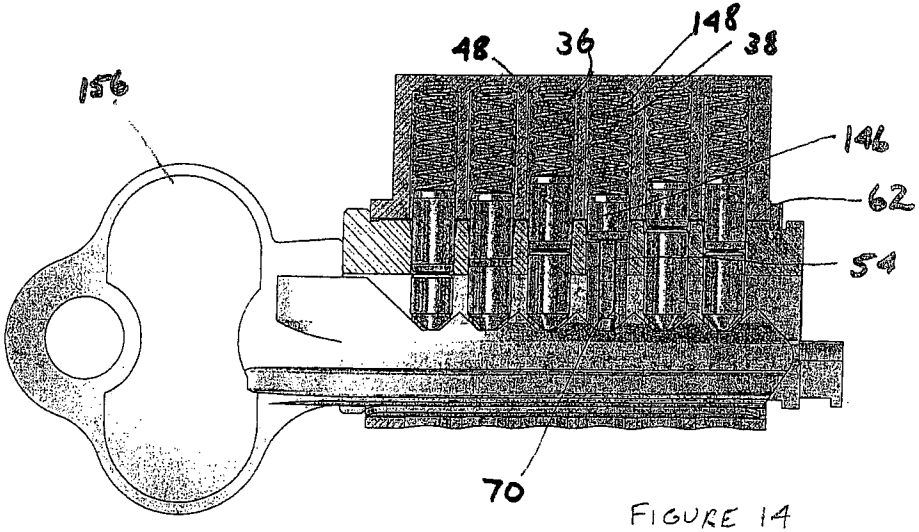
FIG. 14 is a cross-sectional view of the assembled lock assembly of FIGS. 12 and 13, taken along the line indicated by A-A in FIG. 13.

When wafer 54 is in the projecting position, although this detail cannot be seen in FIG. 14, wedge 84 sits inside aperture 88 as shown in FIG. 3. In the first embodiment 10, there was no upper pin part projecting into chamber 38. However, it can be seen from FIGS. 14 and 15 that upper pin part 146 crosses shear line 62 into chamber 38 when wafer 54 is in the projecting position. As a result, projection 84 of wafer 54 as well as upper pin part 146 interfere with shear line 62, impeding rotation of lock barrel 22 within lock body 20. It is only when the correct key (not shown) is inserted into key slot 58 that wafer 54 will be lifted to the correct extent, so that wedge 84 is retracted from aperture 88 and at the same time upper pin part 146 is lifted clear of shear line 62.

Figure 15:
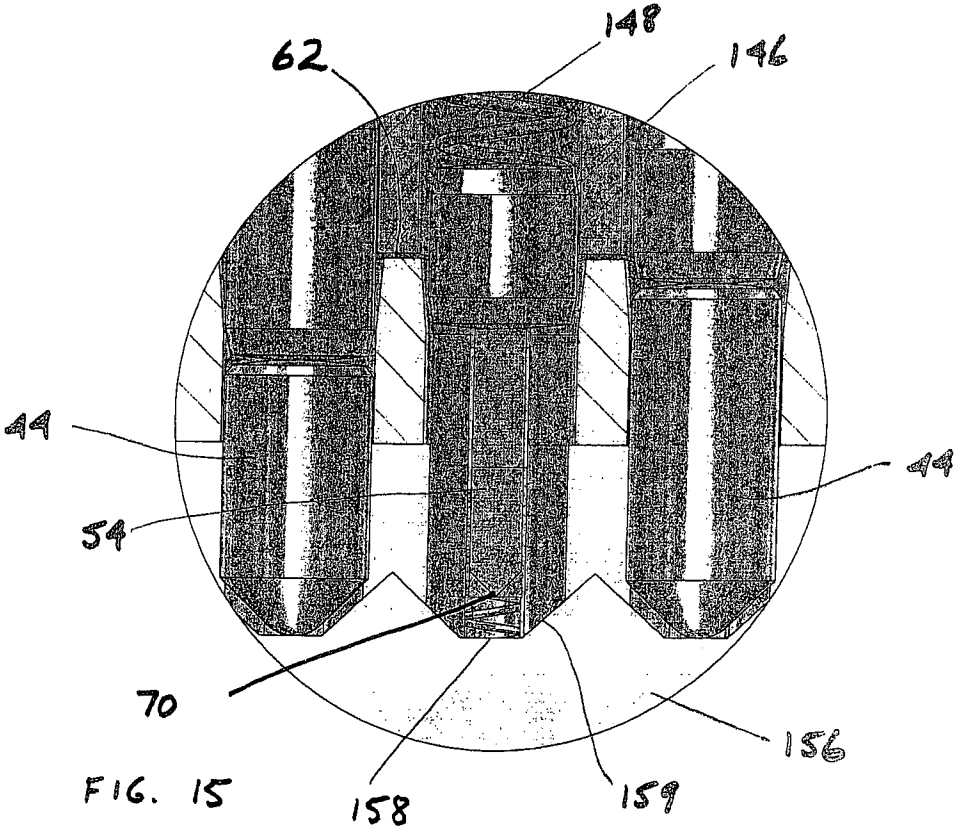
FIG. 15 shows in more detail part of FIG. 14.
Figure 16:
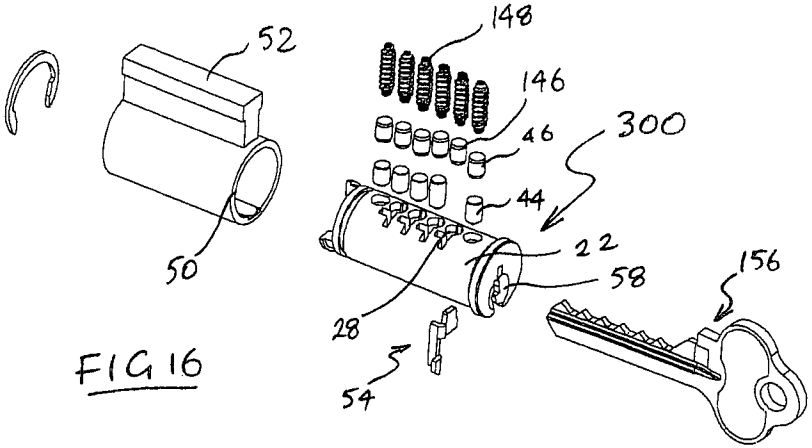

FIG. 15 shows in magnified detail how bump key 156 fails to engage wafer 54. It can be seen that there is a gap between low cut 158 of bump key 156 and key engaging surface 70 of wafer 54 when wafer 54 is in the projecting position. This gap prevents wafer 54 from being "bumped" through contact between key engaging surface 70 with angled faces 159 of cut outs of bump key 156, when bump key 156 is currently "bumping" lower pin parts 44. Because of this gap, upper pin part 146 resting on wafer 54 remains in its original position (locked) when the lower pin parts 44 have been bumped and continues to obstruct shear line 62, to impede rotation of lock barrel 22.

Although the gap is only described in detail with reference to FIGS. 12 to 15, it should be noted that this is a common feature to all of the embodiments described in the present invention. The gap will always be found when a bump key is inserted, although the size of the gap may vary, depending on the configuration of the column and the corresponding low cut of the bump key. As described above, this feature is provided to prevent unauthorised opening of the lock assembly by way of bumping. Turning now to a third embodiment of the lock assembly 300 of the present invention which is shown in FIGS. 16 and 17, most parts are the same as in FIGS. 12 to 15 and the same labels are used for those parts.

Figure 16:
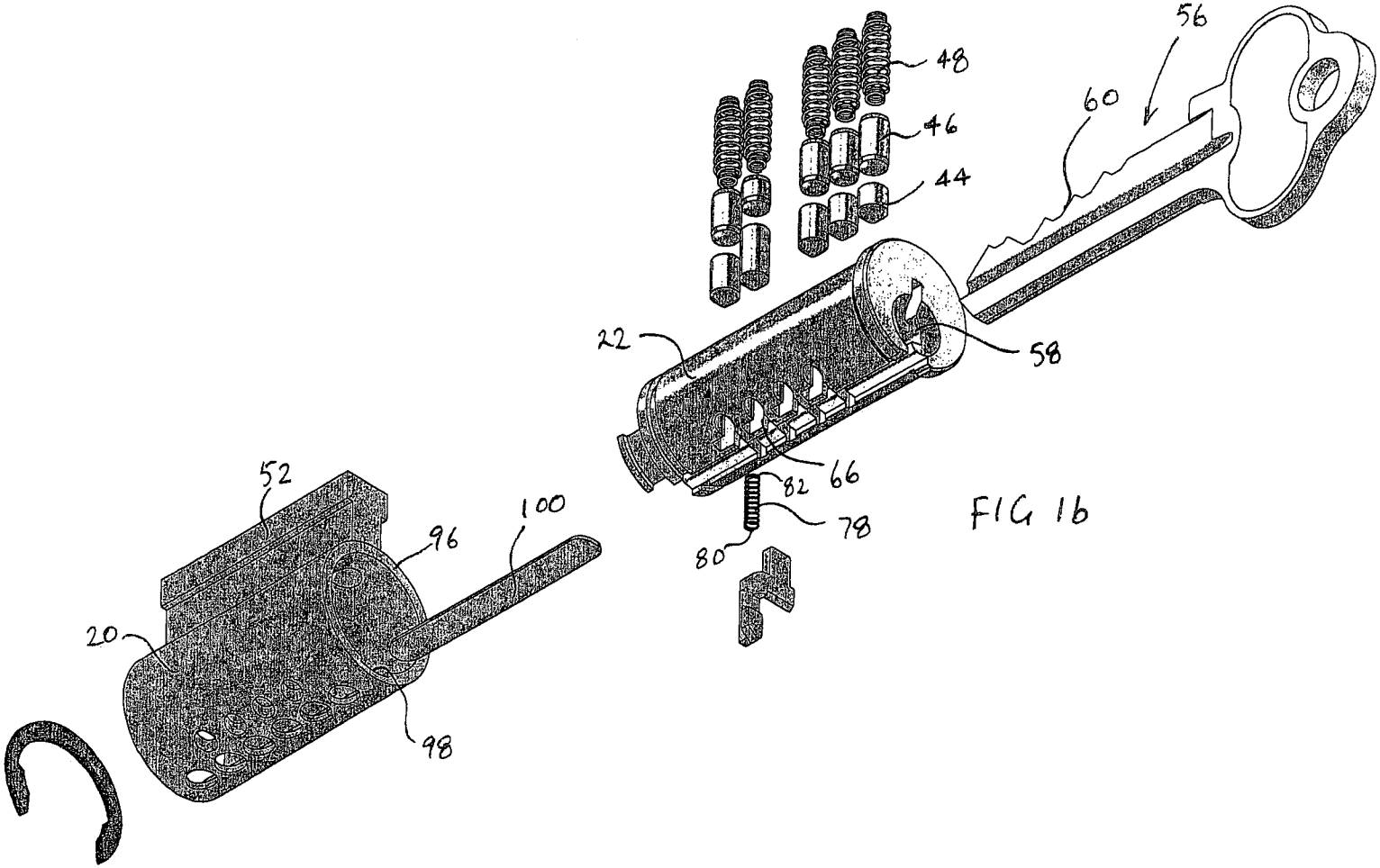
FIG. 16 is an exploded perspective view from above of a third embodiment of lock assembly of the present invention.
Figure 4:
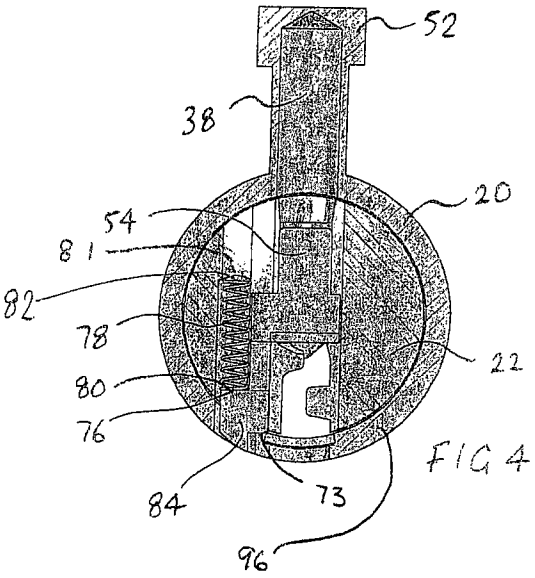
FIG. 4 is a cross sectional view of the assembled lock assembly of FIG. 2 taken along the line indicated by B-B in FIG. 2.
Figure 2:
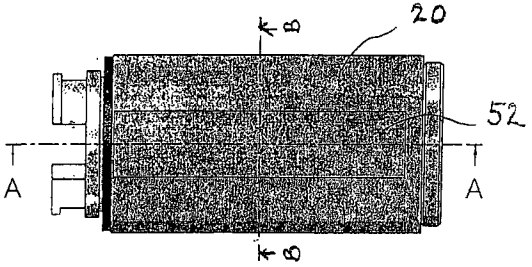
FIG. 2 is a plan view of the assembled lock assembly of FIG. 1.
Figure 17:
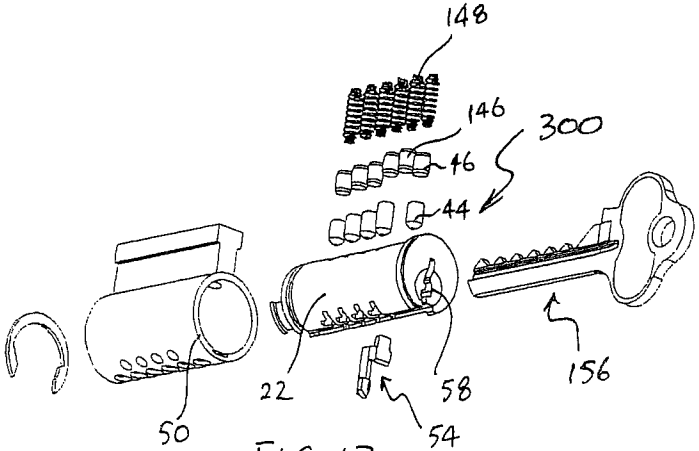
FIG. 17 is an exploded perspective view from below of the lock assembly of FIG. 16.
Figure 18:
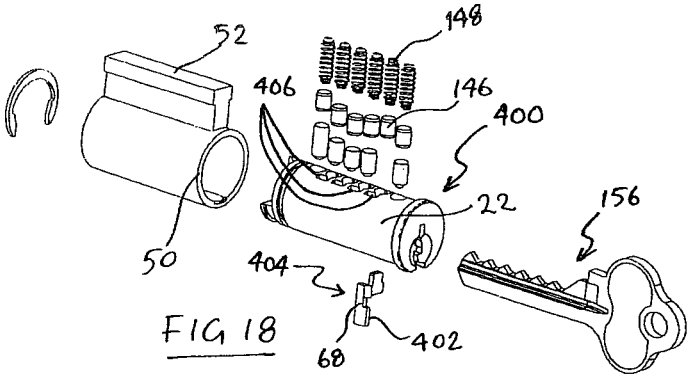
FIG. 18 is an exploded perspective view from above of a fourth embodiment of lock assembly of the present invention.
Figure 19:
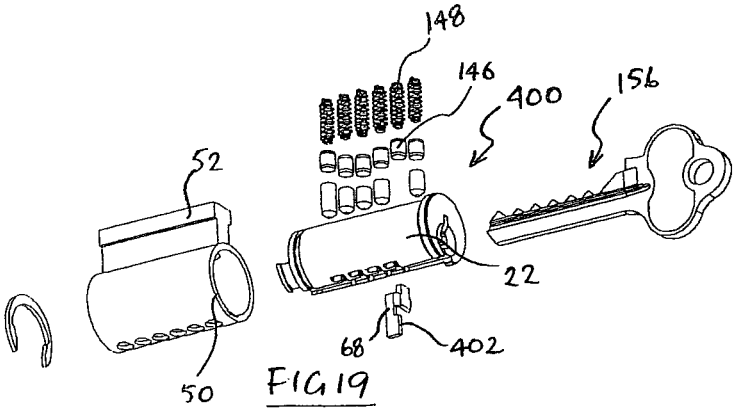
FIG. 19 is an exploded perspective view from below of the lock assembly of FIG. 18.
Figures 20A, 20B, 20C:
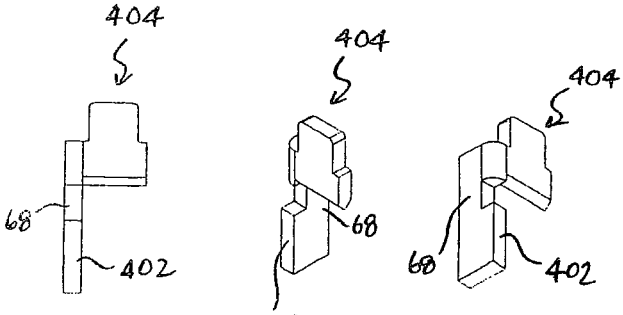
FIG. 20*a* is en end view of a wafer of the lock assembly of FIG. 18.
FIG. 20*b* is a perspective view from one side of the wafer of FIG. 20*a;*
FIG. 20*c* is a perspective view from another side of the wafer of FIG. 20*a;*
Figure 22:
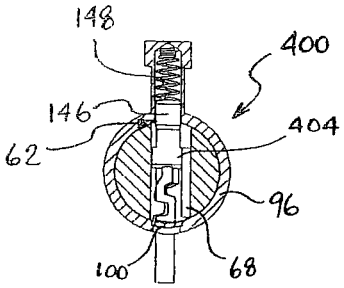
FIG. 22 is a cross sectional view of the assembled lock assembly of FIG. 21 taken along the line B-B.
Figure 21:
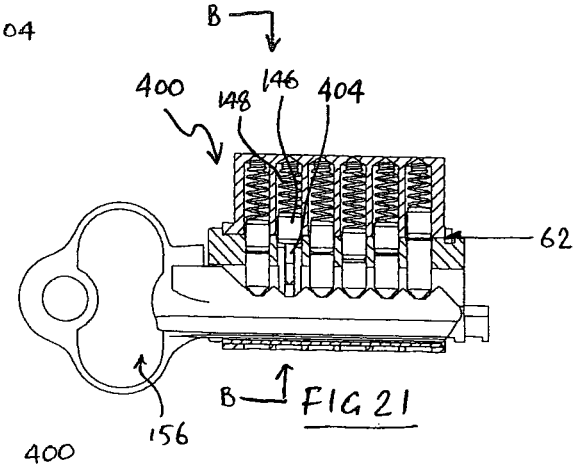
FIG. 21 is a cross sectional view of the assembled lock assembly of FIG. 18.
Figure 23:
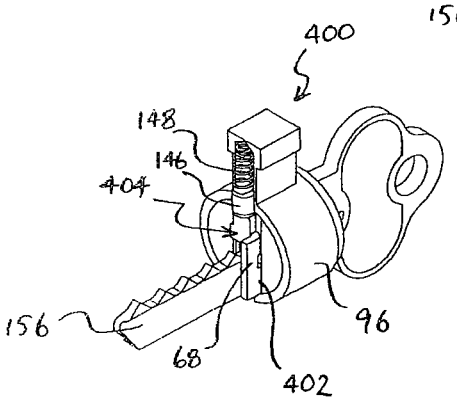
FIG. 23 is a perspective view from one side of the assembled lock assembly of FIG. 21 being cut open along the line B-B showing the interior of the assembly.
Figure 24:
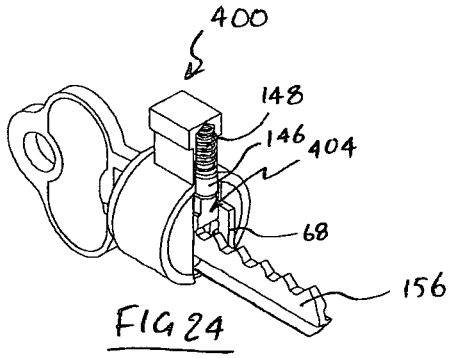
FIG. 24 is a perspective view from another side of the assembled lock assembly of FIG. 21 being cut opened along the line B-B showing the interior of the assembly.
Figure 25:
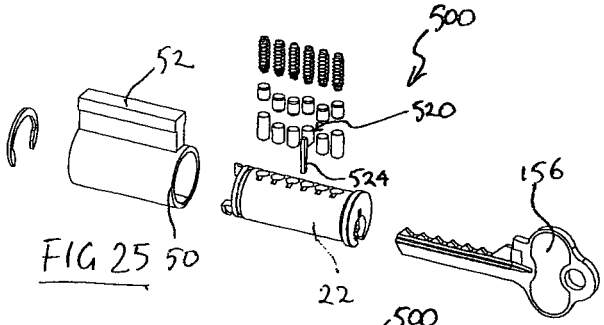
FIG. 25 is an exploded perspective view from above of a fifth embodiment of the lock assembly of the present invention.
Figure 26:
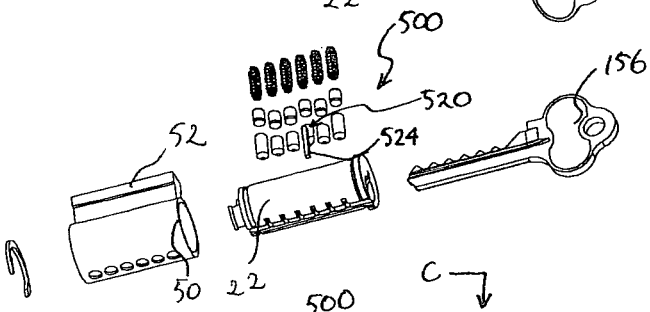
FIG. 26 is an exploded perspective view from below of the lock assembly of FIG. 25.
Figure 27:
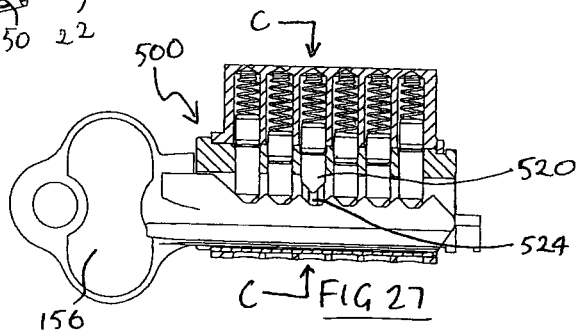
FIG. 27 is a cross sectional view of the assembled lock assembly of FIG. 25.
Figure 28:
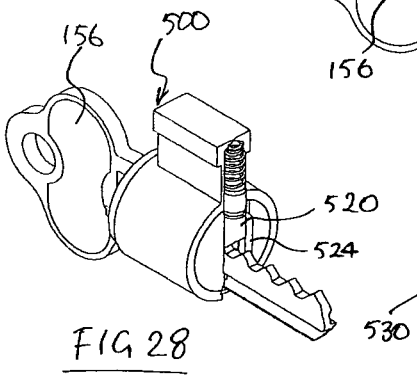
FIG. 28 is a perspective view of the assembled lock assembly of FIG. 27 being cut opened taken along the line C-C showing the interior of the assembly.
Figures 29A, 29B, 29C:
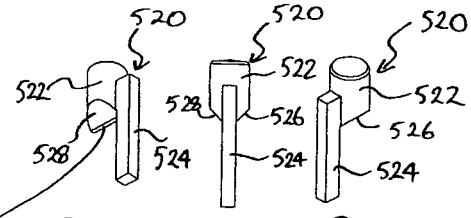
FIG. 29*a* is a perspective view from below of the wafer of the lock assembly of FIG. 25.
FIG. 29*b* is an end view of the wafer of the lock assembly of FIG. 25.
FIG. 29*c* is a perspective view from above of the wafer of the lock assembly of FIG. 25.

As can be seen from FIGS. 16 and 17, this embodiment is basically the same as the second embodiment (shown in FIGS. 12 to 15) except that the spring 78 is omitted (refer back to FIGS. 1*a* and 1*b* for comparison). It will be appreciated that the omission of the spring 78 does not affect the operation of the lock assembly 200 as the upper pin part 146 and spring 148 exist to maintain the position of the wafer 54 when the bump key 156 is inserted or there is no key.

Referring to a fourth embodiment of the lock assembly 400 of the present invention which is shown in FIGS. 18 to 24, most parts are the same as in FIGS. 12 to 17 and hence the same labels are used for those parts.

As shown in FIGS. 18 to 24, this embodiment is mainly the same as the third embodiment described above except that the wafer 54 is replaced by a wafer 404 having a different configuration. As best shown in FIGS. 20*a* to *c*, in place of portion 86, wafer 404 has a branch 402 as an extension from the column 68. In other words, the entire portion 86 including the wedge 84 is omitted from the wafer 54 (refer to FIGS. 18 to 24 for comparison). The branch 402 reinforces the column 68 and rests partially on the floor of the annular wall 96 and the elongate strip 100 respectively.

It will be appreciated that in this embodiment, there is no extension (ie. wedge 84) to enter into the aperture 88 when the wafer 404 is in the projection position. As such, the upper pin part 146 becomes the only feature which acts as a blocking means across the shear line 62 when the bump key 156 or no key is inserted. This would result in a slight reduction in security but is beneficial in that the manufacturing cost is lower without compromising the effectiveness of preventing bumping.

Figure 5:
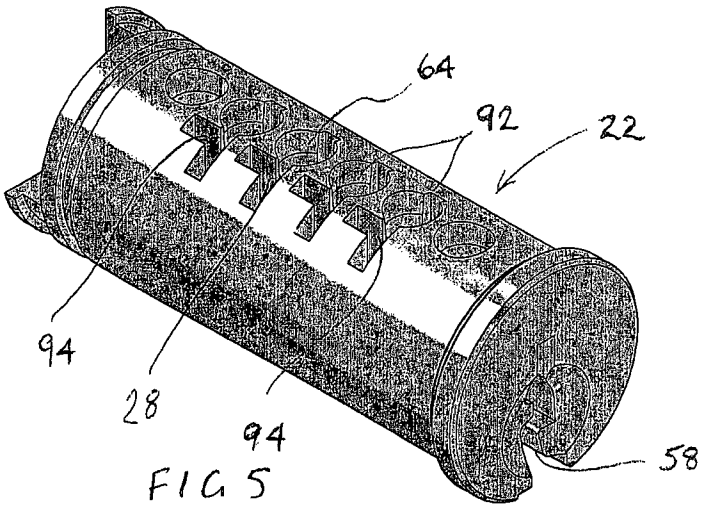
FIG. 5 is a perspective view from above of the lock barrel of the lock assembly of FIG. 1.

To conform to the shape of wafer 404, the broach slots 406 provided in the barrel 22 are of a simple design (instead of the L-shaped broach slots 94 as shown in FIG. 5).

Referring to a fifth embodiment of the lock assembly 500 of the present invention which is shown in FIGS. 25 to 29, most parts are the same as in FIGS. 18 to 24.

As can be seen in FIGS. 18 to 24, this embodiment is mainly the same as the fourth embodiment except that the wafer 404 is replaced by a 'wafer' 520 which has a pin-shaped top 522 (refer FIGS. 29*a* to *c*) and a column 524 which basically functions the same as the column 68 of the above embodiments. The lower portion of the pin-shaped top has a key engaging surface 530 which includes two converging slanting faces 526 and 528 (refer to FIGS. 7 and 8 for comparison with the first embodiment). Although not having the shape of a conventional wafer, wafer 520 has the same functions as those of wafer 404 of the fourth embodiment. The wafer 520 is manufactured by a unique process which has the advantage of involving a lower cost.

Figure 30:
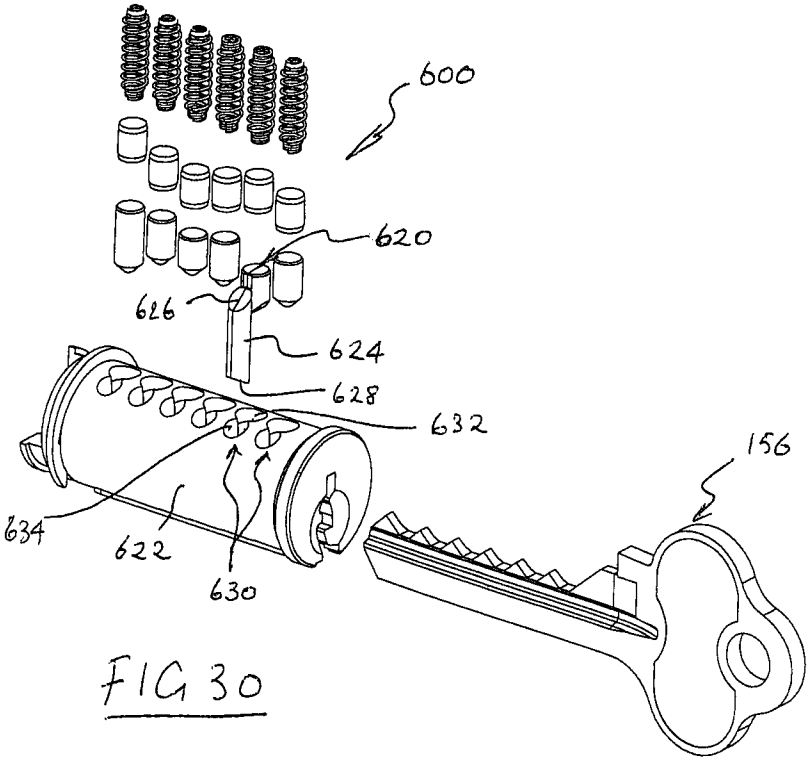
FIG. 30 is an exploded perspective view of a sixth embodiment of the lock assembly of the present invention

Referring to a sixth embodiment of the lock assembly 600 of the present invention which is shown in FIG. 30, most parts are the same as in FIGS. 25 to 29.

As can be seen in FIGS. 25 to 29, this embodiment is highly similar to the fifth embodiment except that the wafer 520 is replaced by a wafer 620 which has a modified column 624 being cylindrical in shape and having chamfered top and bottom ends 626 and 628. The lock barrel 622 has passages 630, each including a pin hole 632 and a cylindrical slot 634 complementary to the shape of the cylindrical column 624. The cylindrical slot 624 is formed by drilling which incurs a relatively lower manufacture cost.

Those skilled in the art will appreciate that the invention described herein is susceptible to variations and modifications other than those specifically described. All such variations and modifications are to be considered within the scope and spirit of the present invention the nature of which is to be determined from the foregoing description.

INDUSTRIAL APPLICABILITY

The lock assembly and wafer of the present invention is industrially applicable in that it minimises the likelihood of unauthorised opening of the lock assembly by bumping with a bump key.

The invention claimed is:

1. A lock assembly comprising:
   - a lock barrel comprising a plurality of passages and being configured to be received in a lock body and to be rotatable from a locked position to an unlocked position at a shear line relative to the lock body;
   - a key slot in communication with the plurality of passages of the lock barrel, the key slot having a lowest part that is positioned furthest away from the plurality of passages of the lock barrel;
   - a plurality of first pins, each having a first pin key engaging surface and each received in one of the plurality of passages of the lock barrel;
   - a plurality of second pins, each biased towards a paired first pin by a pin biasing means; and
   - an element, having an element key bitting cut engaging surface positioned in one of the plurality of passages of the lock barrel, the element being at least one of a wafer or a pin connected to a column, the pin including the element key bitting cut engaging surface, wherein:
   - (a) the element is biased towards the lowest part of the key slot by at least one of:
     - (i) an element biasing means engaging an element biasing means engaging surface on the element; or
     - (ii) an element pin, biased by an element pin biasing means, contacting the element;
   - (b) in the locked position at least one of the element or the element pin interferes with the shear line;
   - (c) when the element is a pin connected to a column, the pin extends in a direction opposite to that in which the element is biased and the column extends in the direction of the bias; and
   - (d) in the locked position, the element key bitting cut engaging surface is located in a position which is further from the lowest part of the key slot than the positions of each of the first pin key engaging surfaces.

2. The lock assembly of claim 1, wherein the lock body includes a portion with a plurality of chambers therein for receipt of the pin biasing means.

3. The lock assembly of claim 2, wherein each chamber is adapted to correspond to one of the plurality of passages in the lock barrel.

4. The lock assembly of claim 1, wherein the passage for the element includes a pin hole for receipt of a pin and a slot for receipt of the element, the pin hole being in communication with the slot.

5. The lock assembly of claim 1, wherein in the locked position a bottom section of the element extends beyond the lock barrel to prevent rotation of the barrel.

6. The lock assembly of claim 1, wherein the element biasing means includes a spring.

7. The lock assembly of claim 5, wherein during unlocking the element is liftable against the element biasing means sufficiently to retract the bottom section of the element into the lock barrel, thus clearing the shear line.

8. The lock assembly of claim 7, wherein the element includes a code-carrying portion which is not liftable sufficiently to project beyond the shear line.

9. The lock assembly of claim 1, wherein, when the lock barrel is locked within the lock body, both the element and the element pin interferes with the shear line.

10. The lock assembly of claim 1, wherein the element is a pin connected to a column and in the locked position the pin contacts the element pin whilst a lower end of the column rests on the lock body.

* * * * *